US012507838B2

(12) United States Patent
Green et al.

(10) Patent No.: US 12,507,838 B2
(45) Date of Patent: Dec. 30, 2025

(54) DISPENSER WITH ROLL TRANSFER MECHANISM

(71) Applicant: Kimberly-Clark Worldwide, Inc., Neenah, WI (US)

(72) Inventors: Jonathan Green, Rossett (GB); Klemen Erzen, Preddvor (SL); Jos Oberdorf, Leiden (NL)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 18/550,989

(22) PCT Filed: Apr. 28, 2021

(86) PCT No.: PCT/US2021/029521
§ 371 (c)(1),
(2) Date: Sep. 18, 2023

(87) PCT Pub. No.: WO2022/231578
PCT Pub. Date: Nov. 3, 2022

(65) Prior Publication Data

US 2024/0306860 A1 Sep. 19, 2024

(51) Int. Cl.
*A47K 10/38* (2006.01)
*A47K 5/12* (2006.01)

(52) U.S. Cl.
CPC ..... *A47K 10/38* (2013.01); *A47K 5/12* (2013.01)

(58) Field of Classification Search
CPC ..... A47K 10/38; A47K 5/12
See application file for complete search history.

(56) References Cited

U.S. PATENT DOCUMENTS

| | | | | |
|---|---|---|---|---|
| 6,839,610 | B2 * | 1/2005 | Carstens | G07F 9/026 700/244 |
| 11,185,453 | B2 * | 11/2021 | Morad | G07F 11/005 |
| 11,351,071 | B2 * | 6/2022 | Loffredo | B65D 83/76 |
| 2003/0158625 | A1 * | 8/2003 | Carstens | G07F 9/026 700/236 |
| 2010/0100236 | A1 * | 4/2010 | Segal | G07F 9/0235 715/702 |

(Continued)

OTHER PUBLICATIONS

International Search Report and Written Opinion for PCT/US2021/029521 dated Aug. 13, 2021, 10 pages.

*Primary Examiner* — Michael Collins
(74) *Attorney, Agent, or Firm* — Dority & Manning, P.A.

(57) ABSTRACT

A dispenser for dispensing dispensable product is provided. The dispenser includes a housing having an interior volume so as to retain the dispensable product. The dispenser also includes a front cover assembly and a backplate that each form at least a portion of the housing. The front cover assembly includes a front plate having a first side and a second and opposite side. The first side forms the exterior of the dispenser and the second side faces the interior volume. A printed circuit board is disposed on the second side of the front plate. The back plate includes a first side and a second and opposite side facing the interior volume. One or more power packs are disposed on the second side of the backplate. The printed circuit board is powered by the one or more power packs when the front cover assembly is in a closed position.

17 Claims, 8 Drawing Sheets

(56) References Cited

U.S. PATENT DOCUMENTS

| | | | | |
|---|---|---|---|---|
| 2010/0163573 | A1* | 7/2010 | Wegelin | G05B 15/02 222/325 |
| 2011/0036855 | A1* | 2/2011 | Petocchi | A47K 10/3612 221/9 |
| 2015/0157177 | A1* | 6/2015 | Carper | A47K 10/38 242/570 |
| 2017/0027394 | A1* | 2/2017 | Arreola Leal | A47K 10/38 |
| 2019/0082897 | A1 | 3/2019 | Carper et al. | |
| 2019/0105211 | A1* | 4/2019 | Morad | G07F 17/18 |
| 2021/0267823 | A1* | 9/2021 | Loffredo | G07F 17/0092 |
| 2023/0264398 | A1* | 8/2023 | Green | B29C 45/14688 40/574 |

* cited by examiner

DISPENSER WITH ROLL TRANSFER MECHANISM

RELATED APPLICATIONS

The present application is the national stage entry of International Patent Application No. PCT/US2021/029521 having a filing date of Apr. 28, 2021, which is incorporated herein in their entirety by reference thereto.

BACKGROUND

Washrooms in commercial and residential buildings typically include products such as toilet tissue, paper towels, diapers, feminine products, liquid products such as soap, and aerosol products such as air fresheners. These products are typically housed by a dispenser and are dispensed as needed by the user. Those skilled in the art have spent considerable time designing smart dispensers that are intended to overcome the problems noted above. For instance, dispensers have been designed that can monitor product usage and product levels in order to prevent waste. The control systems and mechanical aspects of dispensers are wide and varied.

Problems still remain, however, in incorporating different functionalities into dispensers. For example, as additional sensors and control circuitry are added to dispenser problems exist with appropriate ways to connect circuitry components with a power source. For example, certain system utilize a complicated system of connections and wires that can increase the cost of the dispenser and can also increase the complexity of manufacturing. In view of the above, improved mechanisms for powering dispensers are needed.

SUMMARY

In general, the present disclosure is directed to a dispenser for dispensing a dispensable product. The dispenser includes a housing having an interior volume so as to retain dispensable product. The dispenser also includes a front cover assembly that forms at least a portion of the housing. The front cover assembly includes a front plate having a first side and a second and opposite side. The first side of the front cover assembly forms an exterior of the dispenser and the second side faces the interior volume. A printed circuit board is disposed on the second side of the front cover assembly. The dispenser includes a backplate forming at least a portion of the housing. The backplate includes a first side and a second and opposite side. The first side forms an exterior of the dispenser and the second side faces the interior volume. One or more power packs are disposed on the second side of the backplate. The printed circuit board is powered by the one or more power packs when the front cover assembly is in a closed position with respect to the backplate.

Other features and aspects of the present disclosure are discussed in greater detail below.

BRIEF DESCRIPTION OF THE DRAWINGS

A full and enabling disclosure of the present disclosure is set forth more particularly in the remainder of the specification, including reference to the accompanying figures, in which.

Figure 1:
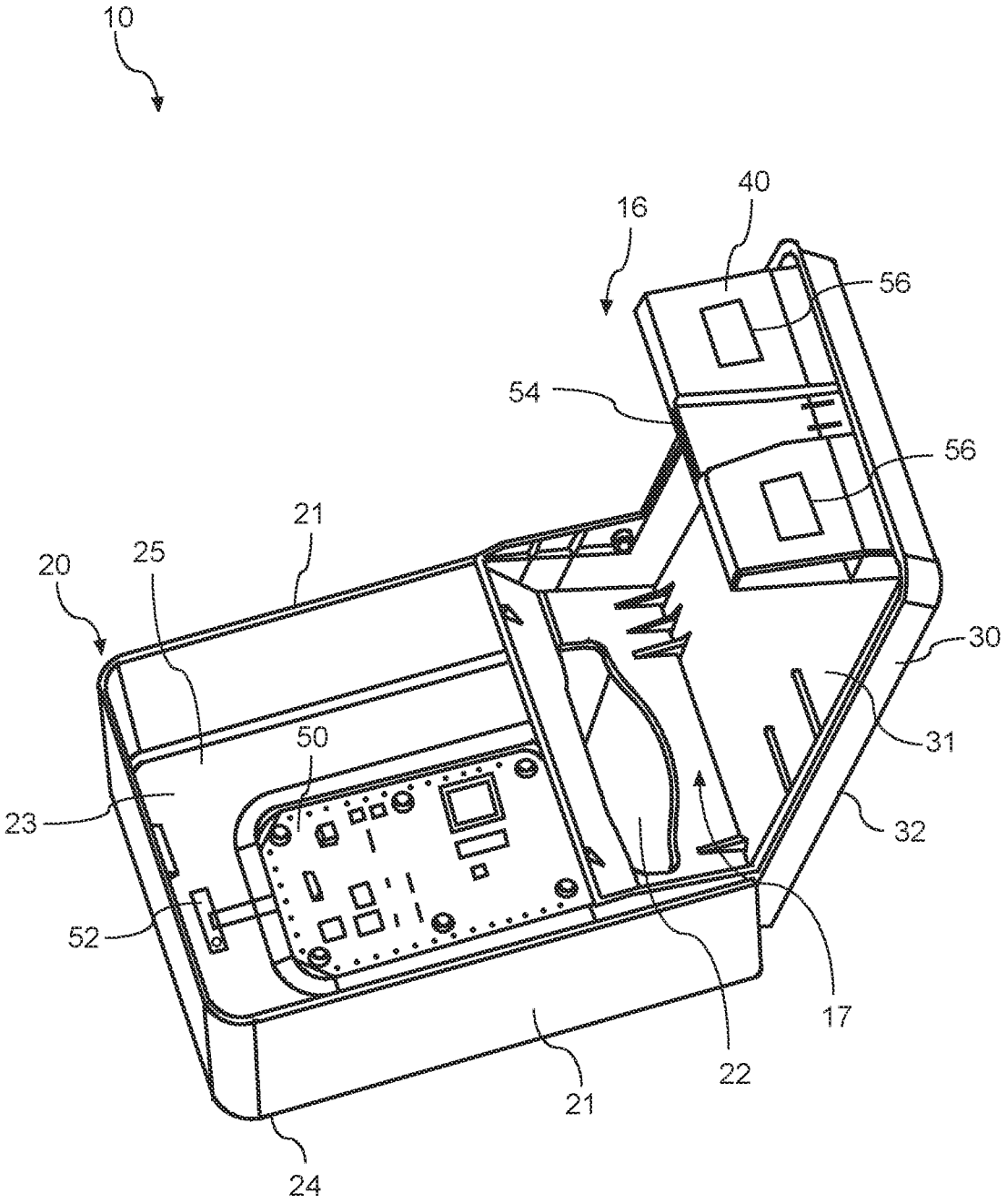
FIG. 1 illustrates a perspective view of a dispenser according to example embodiments of the present disclosure.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only, and is not intended as limiting the broader aspects of the present disclosure.

As used herein, the terms "first", "second", and "third" may be used interchangeably to distinguish one component from another and are not intended to signify location or importance of the individual components.

The terms "coupled," "fixed," "attached to," and the like refer to both direct coupling, fixing, or attaching, as well as indirect coupling, fixing, or attaching through one or more intermediate components or features, unless otherwise specified herein.

The terms "communicate," "communicating," "communicative," and the like refer to both direct communication as well as indirect communication such as through a memory system or another intermediary system.

The singular forms "a", "an", and "the" include plural references unless the context clearly dictates otherwise.

Approximating language, as used herein throughout the specification and claims, is applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 1, 2, 4, 10, 15, or 20 percent margin. These approximating margins may apply to a single value, either or both endpoints defining numerical ranges, and/or the margin for ranges between endpoints.

The embodiments including dispenser and methods of the present disclosure, including components thereof, can comprise, consist of, or consist essentially of the essential elements and limitations of the embodiments described herein, as well as any additional or optional components or limitations described herein or otherwise useful.

As used herein, the terms "sheet material" and "paper" means a material that is thin in comparison to its length and breadth. Generally speaking, sheet materials should exhibit a relatively flat planar configuration and be flexible to permit folding, rolling, stacking, and the like. Exemplary sheet materials and papers include, but are not limited to, paper tissue, bath/toilet tissue, paper towels, wipes, label rolls, or other fibrous, film, polymer, or filamentary products. The terms "sheet material" and "paper" may be used interchangeably.

Dispensers for numerous dispensable products, including liquid products, rolled sheet materials, and folded sheet materials have been developed. Many of these dispensers include components that require some type of power (e.g., sensors, controllers, etc.). For instance, activation sensors are capable of dispensing product upon sensing a user. Other sensors include refill detection sensors, that are capable of sensing when a refill is needed. Dispensers can also include control circuit designed to operate a number of functions of the dispenser. Additionally, certain "smart" dispensers can be equipped with other receivers or beacons that are capable of storing and/or transmitting data via certain wireless connections to cloud-based systems useful for overall dispenser management.

While these electronic components increase the overall usability of the dispenser, powering these components still remains an issue. For example, while electronic components can be powered by a traditional AC/DC power source, often times there are not suitable amounts of AC/DC outlets configured in commercial restroom settings, especially in locations where it is desirable to provide a product dispenser. Furthermore, users enjoy the flexibility in being able to place product dispensers in a manner of locations within restroom establishments. Accordingly, a battery pack can be used in order to power the electrical components of the dispenser. Battery packs however can add substantial weight to the dispenser and, as such, manufacturing designs can be limited. Moreover, connecting the battery packs internally to the electrical components of the dispenser can involve complicated combinations of wires.

Accordingly, the present disclosure is generally directed to a dispenser for dispensing a disposable product. The dispenser includes a housing having an interior volume capable of holding a dispensable product. The dispenser includes a front cover assembly forming at least a portion of the housing. The front cover assembly includes a front plate having a first side and a second and opposite side, the first side forming an exterior of the dispenser, the second side facing the interior volume. A printed circuit board is disposed on the second side of the front cover assembly. A backplate forming at least a portion of the housing is also provided. The backplate includes a first side and a second an opposite side, the first side forming an exterior of the dispenser, the second side facing the interior volume. One or more power packs are disposed on the second side of the backplate. The printed circuit board powered by the one or more power packs when the front cover assembly is in a closed position with respect to the backplate.

The dispenser according to example embodiments of the present disclosure can provide numerous benefits and technical effects. For instance, moving the electronics to the front plate of the dispenser can simplify the design and features of the backplate, thus decreasing manufacturing time and costs. Furthermore, the power packs can be disposed in other features already present on the backplate for dispensing the dispensable product. For example, the power packs can be disposed in a housing, such as an overfill housing, disposed on the backplate. The overfill housing can be present in dispensers configured to dispense folded sheet materials. Additionally, the electrical connection between the printed circuit board and the power packs is simplified. Indeed, one or more plugs are disposed on the internal surface of the front cover and are design to contact the electrical connections on the housing holding the power packs in order to electrically couple the printed circuit board to the power packs when the dispenser is in a closed position. Such electrical connection does not require running any additional wiring from the backplate to the front cover assembly. Furthermore, disposing the printed circuit board in the front plate assembly allows for easier access and programming of the printed circuit board. Additionally, upgraded or improved front cover assemblies can be easily replaced by the end user. Lastly, one or more light emitting devices (e.g., light emitting diodes (LEDs)) can be disposed on the printed circuit board to light features of the front cover. Indeed, this eliminates the need for a strip of LEDs to be strategically positioned on the front cover and electronically wired to the power source, reducing the overall complexity of the design.

FIG. 1 illustrates an example embodiment of a dispenser 10 for dispensing a dispensable product in accordance with embodiments of the present disclosure. The dispenser 10, as shown, is configured for dispensing paper products, such as stacked folded individual sheets of paper towels or sheets of rolled paper products, such as paper towels, toilet paper, and/or toilet tissue. The dispenser 10 is particularly suited for dispensing paper towels, tissues, and the like. However, it should be appreciated that a dispenser according to the disclosure is not limited in this regard. Indeed, the features of the example embodiments of the dispenser 10 illustrated herein are applicable to any type of product dispenser including liquid product dispensers (e.g., hand-soap dispenser, hand sanitizer dispensers), sheet material product dispensers (e.g., dispenser for dispensing sheet material from a rolled sheet), and any other dispensable product dispenser. Furthermore, the dispensers disclosed herein can include in-counter mounted product dispensers, wall-mounted product dispensers, including dispensers mounted to the walls of bathroom stalls, and/or stand-alone product dispensers.

The dispenser will be described herein as it relates to a paper towel dispenser for clarity and ease of explanation. It should also be appreciated that a dispenser according to the disclosure is not limited in its overall shape or configuration. This particular dispenser is illustrated merely as an example of one embodiment of a dispenser incorporating the unique features of the present disclosure.

As shown in FIG. 1, the dispenser 10 includes a housing 16 having a interior volume 17 that is designed to house one or more dispensable products. The housing 16 may be formed of any suitable materials. The dispenser 10 includes a front cover assembly 20 and a backplate 30. The front cover assembly 20 is shown in an open position. In certain embodiments, the front cover assembly 20 can define one or more of the sidewalls 21 of the dispenser 10. In other embodiments, however, the front cover assembly 20 can form at least a portion, but not substantially all, of the sidewalls 21 of the dispenser. In other embodiments, however, the front cover assembly 20 does not form any portion of the sidewalls 21 of the dispenser. The front cover assembly 20 can be pivotally coupled to the backplate 30. For example, one or more hinges can be used to pivotally coupled the front cover assembly 20 to the backplate 30. Any conventional pivotal attaching mechanism may be used in this regard. For example, in certain embodiments, a simple rotatable rod is provided and retained by rod holders. It should be appreciated that any number of conventional pivotal arrangements are known by those skilled in the art that may be utilized to pivotally mount the front cover assembly 20 to the backplate 30. In other embodiments, the front cover assembly 20 can be completely removable or detachable from the backplate 30.

The front cover assembly 20 includes a front plate 23 having a first side 24 defining an external surface of the dispenser 10 and a second side 25 (e.g., an internal side) facing the internal volume 17 of the dispenser 10. One or more circuit boards, such as a printed circuit board 50, are disposed on the second side 25 of the front cover assembly. Additionally, the second side 25 of the front cover assembly 20 can be outfitted with one or more electronic interfaces 52 including, for example, suitable electrical connectors and/or plugs, suitable for electrically coupling the printed circuit board 50 to one or more power packs 56. Electrical coupling of the printed circuit board 50 to the one or more power packs 56 will be further discussed hereinbelow.

The dispenser includes a backplate 30 having a first side 31 forming an exterior of the dispenser 10. The first side 31 may face the mounting surface (e.g., a wall or a stall door) when the dispenser 10 is in a mounted position. The backplate 30 also includes a second side 32 opposite from the first side 31, the second side 32 generally facing the interior volume 17 of the dispenser 10. The backplate 30 can include additional features in order for the dispenser to be properly mounted to a mounting surface. For example, the backplate 30 can include a variety of apertures, pins, or other features designed to facilitate mounting of the dispenser.

As shown in FIG. 1, one or more power packs 56 are disposed on the backplate 30. The term power packs 56 can refer to any type of portable power source. For example, in certain embodiments, the power packs 56 can include one or more batteries for powering certain electrical components of the dispenser 10. For example, in certain embodiments, one or more power packs 56 are disposed directly on an internal surface 31 of the backplate 30. (Not Shown). Indeed, while exemplary embodiments illustrate the power packs 56 disposed on the backplate 30, the disclosure is not so limited. In fact, the power pack could be disposed anywhere within the interior volume 17 of the housing 16. For example, the power packs 56 could be disposed on other modules (e.g, dispensing modules) or housings disposed within the interior volume 17 of the housing 16.

Figure 2:
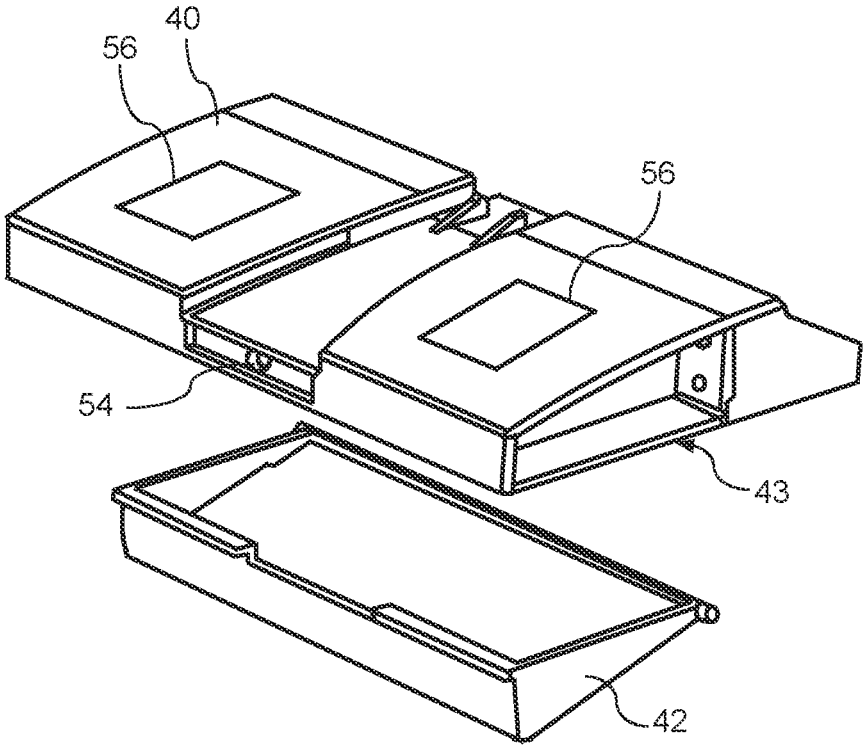
FIG. 2 illustrates a perspective view of a housing member according to example embodiments of the present disclosure.
Figure 3:
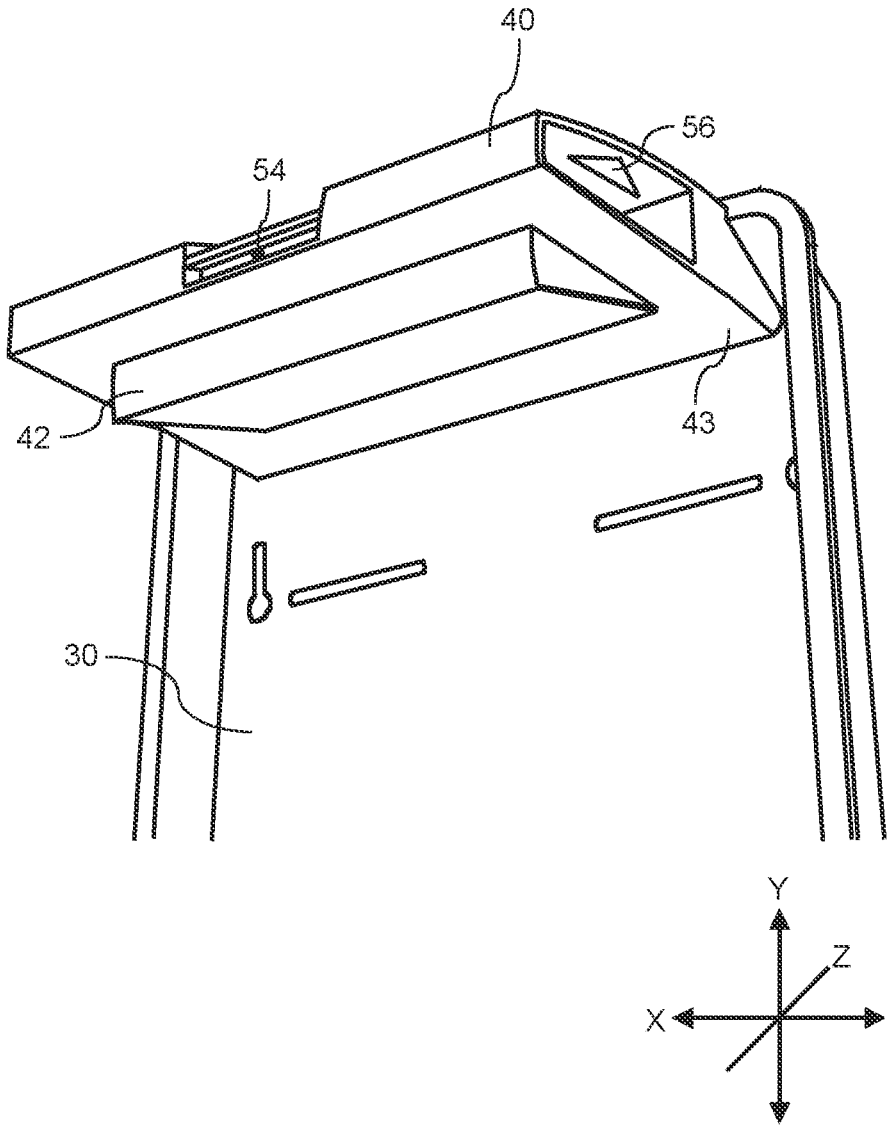
FIG. 3 illustrates a perspective view of a backplate according to example embodiments of the present disclosure.

In other embodiments, however, a housing member 40 is coupled to the backplate 30. The housing member 40 can be configured in any shape or with any suitable material and is configured to house one or more power packs 56. For example, in certain embodiments, the housing member 40 includes at least a portion of an overfill prevention mechanism 42 or overfill housing. For example, referring now to FIGS. 2-3, illustrated is a housing member 40 and an overfill prevention mechanism 42. The overfill prevention mechanism 42 is pivotally attached to an underside 43 of the housing member 40. When the dispenser 10 is in an open position, a stack of sheet material (e.g., folded paper towels) can be loaded in the interior volume 16 of the housing 16. The stacked sheet material, however, can only be loaded to a certain height before the top of the stacked sheet material encounters the overfill prevention mechanism 42. Once the stacked sheet material is loaded and the dispenser 10 is in a closed position, the overfill prevention mechanism 42 is capable of pivoting upward in the y-direction in order to prevent overfill of the dispenser 10. In such embodiments, void space located within the housing member 40 that includes the overfill prevention mechanism 42 can be loaded with one or more power packs 56. Conveniently, in such an embodiment, no additional housing for the power packs needs to be configured to the backplate 18 of the dispenser 10.

As shown, the housing member 40 includes one or more electronic interfaces 54. For example, the electronic interface 54 can be disposed on a portion of the external surface of the housing member 40 such that when the front cover assembly 20 is in a closed position, electronic interface 52 is able to electrically couple to electronic interface 54 in order to connect the printed circuit board 50 to the one or more power packs 56. Furthermore, while exemplary embodiments illustrate placement of electronic interface 54 on the housing member 40, the disclosure is not so limited. Indeed, the electronic interface 54 can be located anywhere within the interior volume 17, such that the electronic interface 54 is capable of interfacing with the printed circuit board 50 in a manner to provide power and/or functionality to the printed circuit board 50.

Referring back to FIG. 1, the housing 16 includes at least one dispensing opening 22 through which the paper product is dispensed from the internal volume 17. In the illustrated embodiment, the dispensing opening 22 is defined in the bottom the housing 16. However, the dispensing opening 22 could be located anywhere convenient for the dispensing of suitable product. For example, the dispensing opening 22 could also be defined in a bottom portion or panel member of the front cover assembly 20. The dispensing opening 22 may be disposed in any convenient location for a user to pull and dispense the individual folded sheets from the housing 16.

Figure 4:
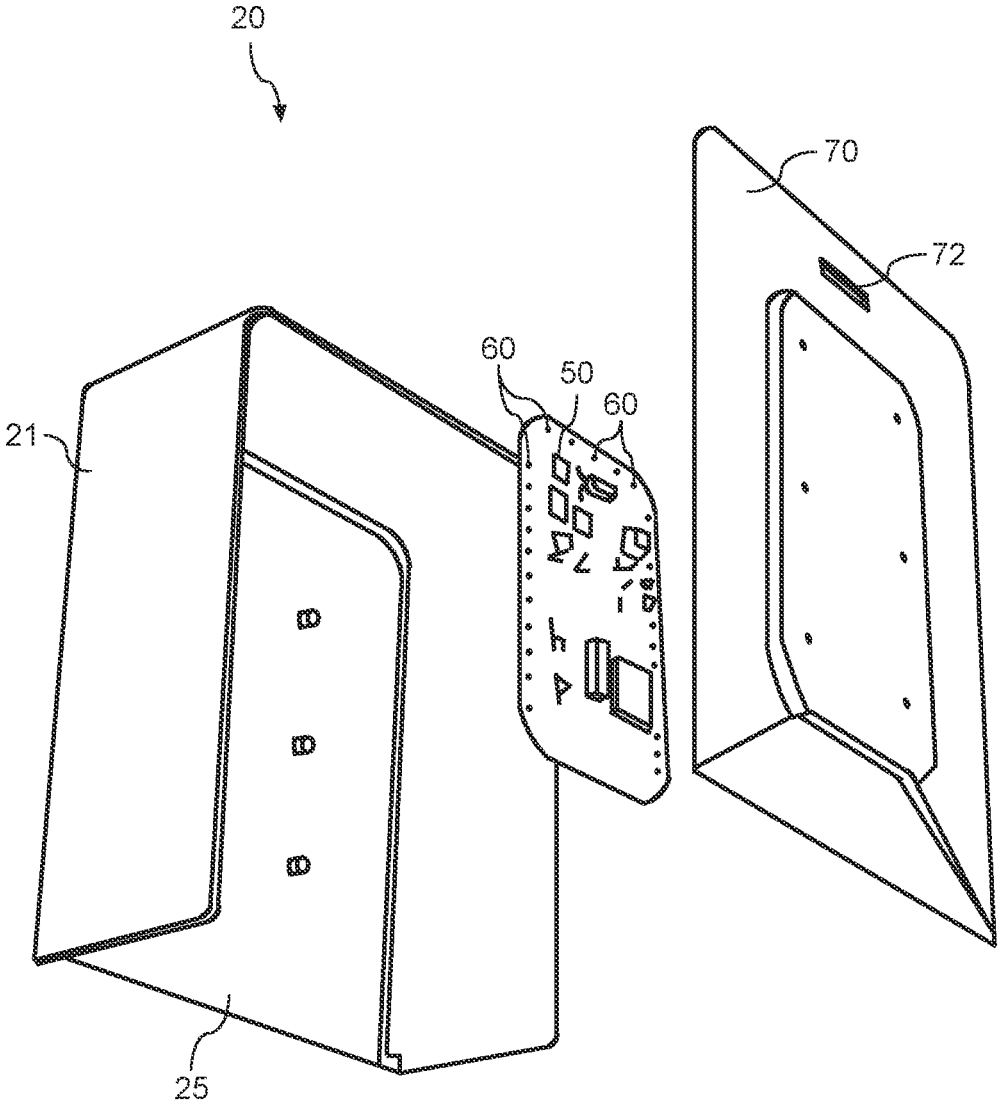
FIG. 4 illustrates an exploded view of a front cover assembly according to example embodiments of the present disclosure.
Figure 5:
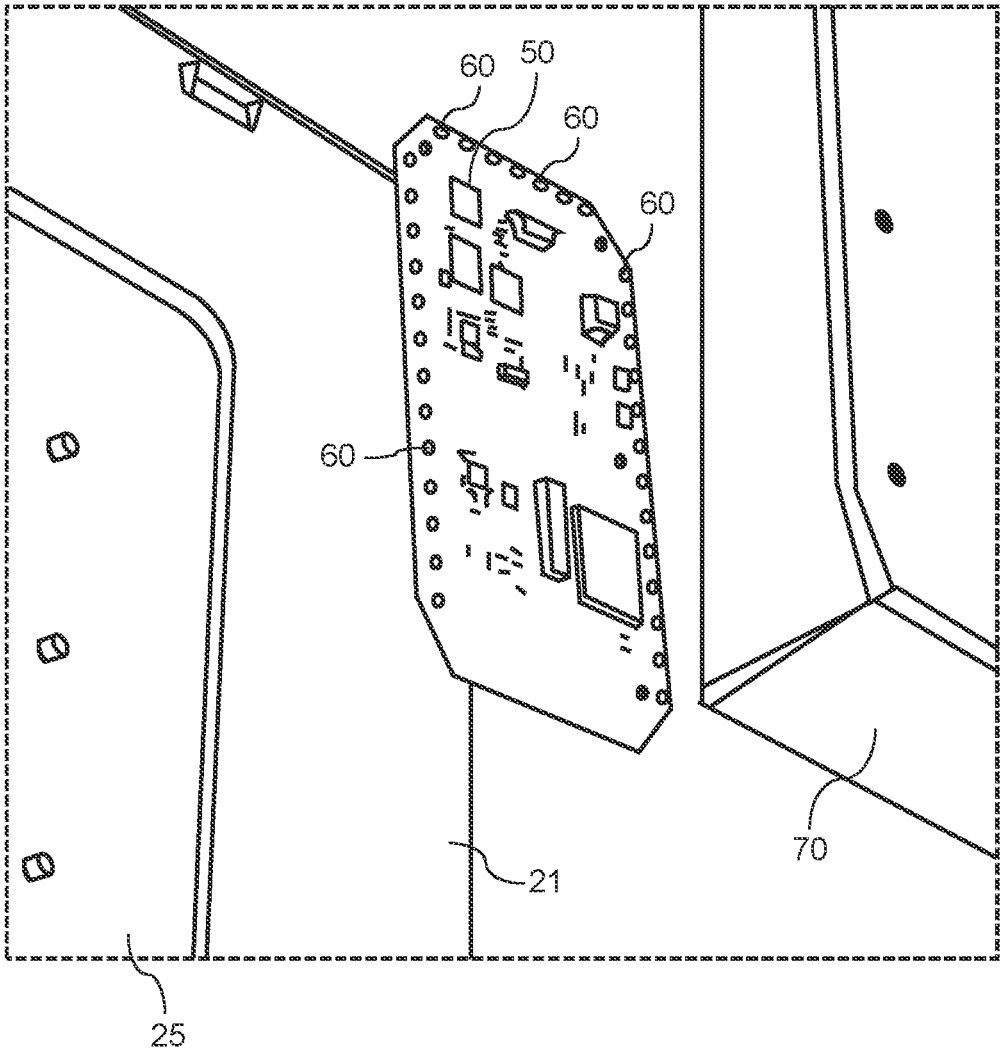
FIG. 5 illustrates an exploded view of a front cover assembly according to example embodiments of the present disclosure.

Referring now to FIGS. 4-5, exploded views of the front cover assembly 20 including the printed circuit board 50 and sidewalls 21 are shown. As shown, the front cover assembly 20 includes a second side 25 configured to face the internal volume 17 of the dispenser 10. The printed circuit board 50 is disposed on at least a portion of the second side 25 of the front cover assembly 20. The printed circuit board 50 can be removably attached or permanently affixed to the second side 25 of the front cover assembly 20. For example, in certain embodiments, one or more pins or fastening devices can be used to secure the printed circuit board 50 to the second side 25 of the front cover assembly 20. A protection plate 70 can be disposed between printed circuit board 50 and the internal volume 17 of the housing 16. For example, the protection plate 70 can protect the various components present on the printed circuit board 50 from exposure dirt, dust, and other contaminants that can affect the operability of the printed circuit board 50. In order to ensure proper electrical connection of the printed circuit board 50 to the power packs 56, a connection aperture 72 can be disposed in the protection plate 70 in order to allow for electrical coupling between the electronic interface 52 located on the second side 25 of the front cover assembly 20 and electronic interface 54 located on the backplate 30 or housing member 40 located on the backplate 30 of the dispenser 10.

Figure 6:
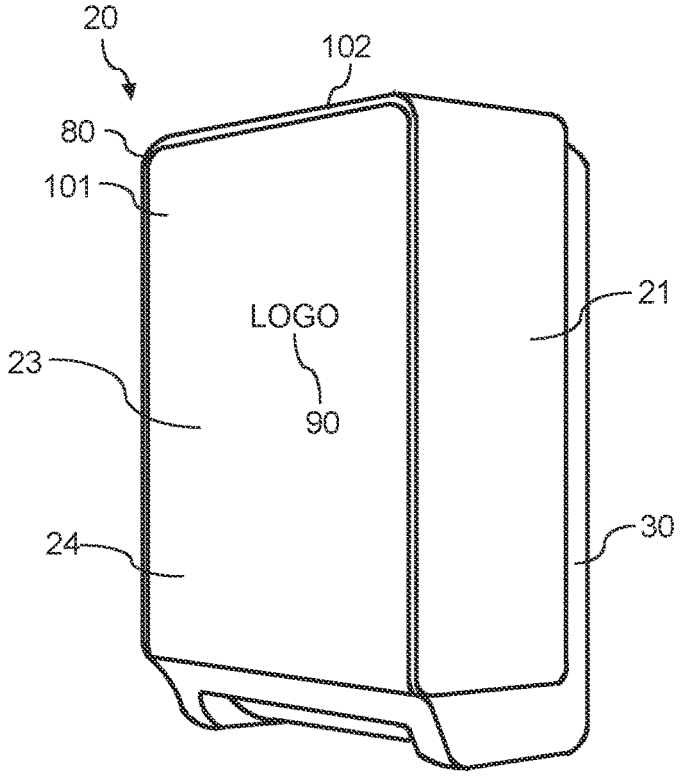
FIG. 6 illustrates a perspective view of a dispenser according to example embodiments of the present disclosure.
Figure 7:
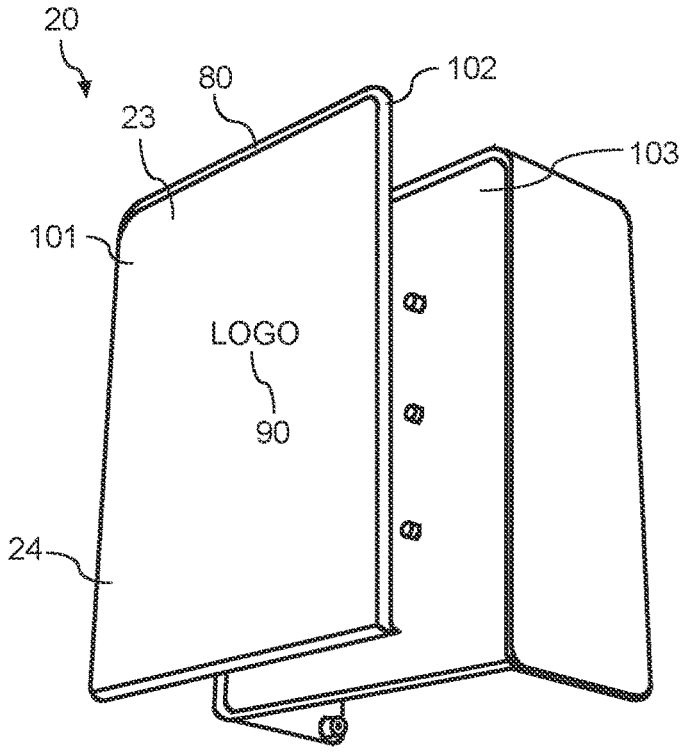
FIG. 7 illustrates a perspective view of a front cover assembly according to example embodiments of the present disclosure.

The printed circuit board 50 can include a variety of components or can be configured to operate a variety of components including sensors, control circuitry, wireless connections, etc. For example, in certain embodiments, one or more light emitting devices 60 (e.g., light emitting diodes)

can be placed on the printed circuit board 50. In such embodiments, when operated, the light emitting devices 60 can be configured to illuminate certain features present on the front cover assembly 20. Referring now to FIGS. 6-7, these features include a border 80 and/or logo 90. As shown in FIG. 6, the front cover assembly 20, including sidewall 21, is in a closed position on the backplate 30. Whereas in FIG. 7, the front cover assembly 20 is shown in an exploded view. The front cover assembly 22 includes a front plate 23 having a first side 24 that forms an externally facing portion of the dispenser 10. As shown, the front plate 23 can include a first layer 101 that is generally formed from an opaque material. For example, the first layer can be formed from a suitable opaque label. The opaque label can be in-molded to a second layer 102 of transparent material 102. The second layer 102 including the transparent material can form at least a portion of a border 80 around the front plate 23. As shown in FIG. 7, in embodiments, the front plate 23 including the border 80 as described, can then be connection to a internal front plate 103 useful for affixing the front plate 23 to the front cover assembly 20. When utilized, the internal front plate 103 can also be formed from a transparent material. In such embodiments, when the light emitting devices 60 present on the printed circuit board 50 are activated, the light produced is able to filter through the border 80 to illuminate the border 80 of the front cover assembly 20 with light. Furthermore, the front plate 23 can include a logo 90 or any other suitable design thereon. Similar to illumination of the border 80, the logo 90 or other front plate 23 design can be illuminated by the light emitting devices 60 present on the printed circuit board 50. Advantageously, such illumination of the border 80 and/or logo 90 as described, eliminates the need to place a strip of light emitting devices 60 (e.g., LEDs) in a desired location, such as directly behind the border or directly behind the logo, in order to illuminate the features of the front plate.

Figure 8:
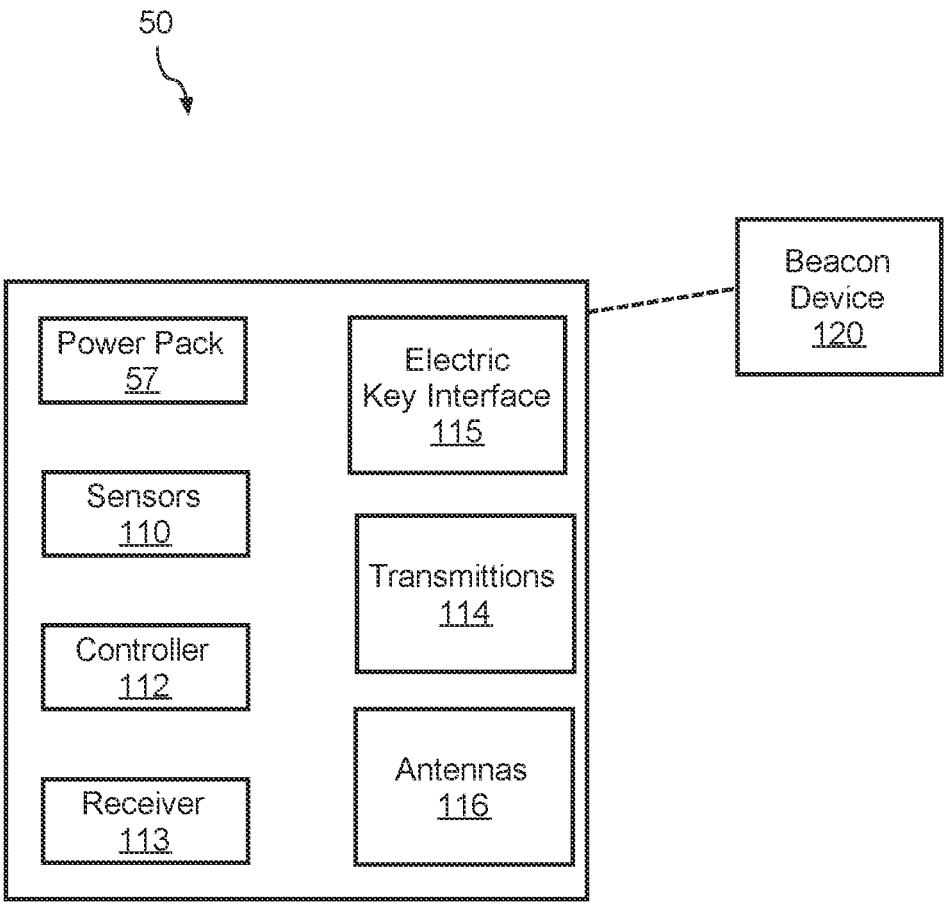
FIG. 8 illustrates a block diagram of a printed circuit board according to example embodiments of the present disclosure.

Referring now to FIG. 8, the printed circuit board 50 can include one or more components or features for facilitating operational functionality of the dispenser. For example, one or more smaller power packs 57 (i.e., power pack 57 is smaller or weights less than power pack 56) can be disposed on or adjacent to the printed circuit board 50. For example, the smaller power packs 57 can be used to power certain components or features of the printed circuit board 50 when the front cover assembly is in an open position (e.g., when electronic interfaces 52 and 54 are not connected). In such embodiments, the smaller power packs 57 are used to power certain functions of the printed circuit board 50.

Additionally, the printed circuit board 50 can include one or more sensors 110. A variety of sensors 110 can be powered-by or coupled to the printed circuit board 50. For example, in certain embodiments, the printed circuit board 50 can include one or more refill detection sensors that can indicated when a low product condition exists. For example, the refill detection sensor can include known components for tracking the amount of product present in the interior volume of the dispenser. Upon a threshold low product condition being reached, the refill detection sensor can alert a user or maintenance personnel that the dispenser is low on product. For example, when a low product threshold is reached, and externally visible light on the dispenser can be illuminated, indicating that the product is low. For example, an illuminated red light on an external surface of the dispenser often indicates that a low product condition exists. In other embodiments, the sensors 110 can include a sensor that is designed to detect the presence of a user in a detection zone. Such sensors are known, and are used to detect when a user is within a certain distance from the product dispenser. In such embodiments, the user detection sensor can be used to illuminate the product dispenser or a certain amount of product can be dispensed from the dispenser upon sensing the user in the detection zone. Again, such sensors are known and can be incorporated into the printed circuit board 50 provided herein by those of skill in the art.

The printed circuit board can also include a controller 112, receiver 113, transmitter 114, and/or antenna 116 all suitable for receiving and communicating data to and from the dispenser. For example, the controller 112 can include a controller and/or control circuitry configured to control and monitor all the functions of the dispenser including, for example, the amount of product being dispensed, product usage, and any other activities that are occurring within the dispenser. The control circuitry can be configured to communicate information regarding the dispenser to a server system (e.g., a cloud-based management service) via wired means or through a web-based system as will be described more particularly herein. For instance, the control circuitry can include a receiver 113 configured to interface with one or more beacon devices.

In other embodiments, the printed circuit board 50 can include at least a portion of or be configured to operate an electronic key interface 115. For example, the front covers of many commercially available dispensers include a locking mechanism designed to keep users from tampering with the internal components and products located within the dispenser. Such mechanical locks require maintenance personnel to carry around keys in order to unlock dispenser for servicing. However, an electronic lock or a combination of an electromechanical lock can be used in order to open the product dispenser. For example, maintenance personnel can carry a beacon device 120 capable of transmitting a unique beacon signal. The beacon device 120 can be incorporated to the user's cell phone or the beacon device 120 can be carried by maintenance personnel as part of a small, portable device in the form of an attachment to a work badge, bracelet, token, dongle, ID card and so forth. When the beacon device 120 is detectable (e.g., within range) of the electronic key interface 115 on the printed circuit board 50, the front cover assembly of the dispenser can be opened, such that dispensable product can be refilled.

In certain embodiments, the components of the printed circuit board 50 and/or dispenser 10 are equipped with wireless communication capability between receivers 113 in the dispensers and other beacon devices 120 or receivers located outside of the dispensers in the restroom area. In such embodiments, the dispensers are considered to be "communication-enabled" devices. In certain embodiments, it has been found that Bluetooth Low Energy technology is particularly well-suited for facilitating wireless communication of dispensers 10 in accordance with the present subject matter. For example, the beacon device 120 carried by the maintenance personnel may be a Bluetooth Low Energy beacon that transmit the unique beacon signal as a Bluetooth Low Energy formatted signal, and the receivers 113 are Bluetooth Low Energy scanners configured to receive and recognize the Bluetooth Low Energy formatted signal.

Bluetooth Low Energy devices are well-known to those skilled in the art, and a detailed explanation of their function and operation is not necessary for an understanding and appreciation of the present invention. Briefly, Bluetooth Low Energy beacons are a class of low-energy, low-cost radio transmitters that can alert and/or notify a receiver running Bluetooth Low Energy applications of their presence, which in turn enables the receiver to perform certain actions when in close proximity to the beacon. Each Bluetooth Low Energy beacon broadcasts a unique beacon signal using the Bluetooth Low Energy standard format. These unique signals are also known as beacon "advertisements." The Bluetooth Low Energy receiver runs an application that enables the device to scan for and receive the signals within transmitting range of the Bluetooth Low Energy beacons. The receiver will automatically "react" to the received signal and may start other Bluetooth Low Energy-enabled applications for various purposes, including communication with a central server.

A typical use of Bluetooth Low Energy technology is relatively precise indoor geo-location ("micro-location"). A Bluetooth Low Energy-enabled application on the receiver is notified when the Bluetooth Low Energy beacon (beacon device 120) moves out of range of the receiver, and thus is able to determine distance of the beacon device 120 (and thus the maintenance personnel) from the receiver 113. The exact geo-location of the receiver 113 is known, and thus the exact location of the beacon device 120 is calculated based on relative distance from the receiver 113 as a function of signal strength. With this location information, the server system in communication with the receivers 113 can identify a dispenser that has been serviced based on location of the personnel within a washroom facility (e.g., by reacting with a receiver 113 located within a particular dispenser).

It should be appreciated that the present systems and methods are not limited to Bluetooth Low Energy technology. The beacon device, the receiver, and/or other wireless devices can implement any suitable wireless protocol to perform wireless communications as described herein. As examples, the wireless protocol can include, but is not limited to, Long Range (LoRa), Near Field Communication (NFC), High-Frequency (HF) RFID, Ultra-High Frequency (UHF) RFID, Ultra-wideband (UWB), Institute of Electrical and Electronics Engineers (IEEE) 802.15.4, Thread, Zigbee, Wirepass, Encoean/ISO/IEC 14543.3.1x, WiFi or IEEE 802.11, cellular services (e.g., 4G Long-Term Evolution (LTE), 5G, etc.), NarrowBand-Internet of Things (NB-IoT), or any other suitable wireless protocols. Other communication technologies are also within the scope and spirit of the disclosure.

As noted, inclusion of the printed circuit board on the front cover assembly allows for easier replacement of the front cover assembly and associated functionality of the printed circuit board. The functionality of the entire dispenser can be upgraded or modified just by changing out the front cover assembly. For example, the dispenser can include a second front cover assembly having a second printed circuit board disposed thereon. The second printed circuit board can be configured to provide a different functionality to the dispenser. The second front cover assembly, including second printed circuit board, can be used to replace or instead of the front cover assembly present on the dispenser. Such embodiments are not limited to dispensers including only one or two front cover assemblies. In fact, a plurality of front cover assemblies each having a printed circuit board thereon in accordance with exemplary embodiments of the present disclosure can be provided. The printed circuit boards of each front cover assembly can include the same or different functionalities. For example, it is contemplated that at least two front cover assemblies (e.g., a first front cover assembly and a second front cover assembly) can be provided that each include printed circuit boards thereon having different functionalities. The different functionalities can correspond to operation of different sensors, controllers, light emitting devices, etc. The different printed circuit boards can also be outfitted with different features (e.g., sensors, controllers, etc.) in order to provide different functionalities to the dispenser. Providing different front cover assemblies allows the end user to have multiple options for the overall function and design of the dispenser.

The dispenser can include any number of operational components housed in the housing and/or located external to the housing. Suitable operational components can vary depending on the type of dispenser and product to be dispensed. For example, the operational components of the dispenser can be mounted directly to the backplate of the housing or can be part of a module that is received within the housing. For example, the operational components can be part of a module that may be readily removable from the housing for servicing and/or replacing components without the necessity of having to remove the entire dispenser from its support surface. For dispensing paper products, such as one or more rolls of sheet material, the operational components can include rollers, such as pressure rollers, drive rollers, drive motors, gear assemblies, and control circuitry, including, for example, controllers or microprocessors, for driving paper product from the roll of sheet material out through a dispensing opening. Additional roll holders, including main roll holders and stub roll holders, can also be included in the dispenser. Additional transfer mechanisms may also be present in order to transfer dispensing between a stub roll and a main roll. Such components are known by those of skill in the art and can be incorporated accordingly herein. Additionally, tear bars or cutting bars may be present in order to cut the paper product as it is dispensed from the dispensing material. In certain embodiments, the dispenser can be configured to dispense a particular amount of sheet material. Dispensing mechanisms can be powered by batteries in a battery component or can be powered by an AC to DC distribution system.

In certain embodiments, the dispenser can be configured as a liquid product dispenser. Liquid product dispensers are suitable for dispensing a liquid product, such as hand soap, hand sanitizer, or other personal care products. While the term "liquid product" is used, the disclosure is not so limited. Indeed, the product dispensed could be a viscous liquid, such as hand soap, or a foam product, such as foamed hand soap. The disclosure is intended to cover a variety of liquid products that can be dispensed in a viscous or foamed state. Liquid product dispensers can include a variety of features and operational components including delivery spouts, motors, motor housings, pump devices, electronic sensors, control circuitry, liquid product reservoirs, delivery tubes, power supply housings, electrical contacts, battery compartments, and combinations thereof.

Figure 9:
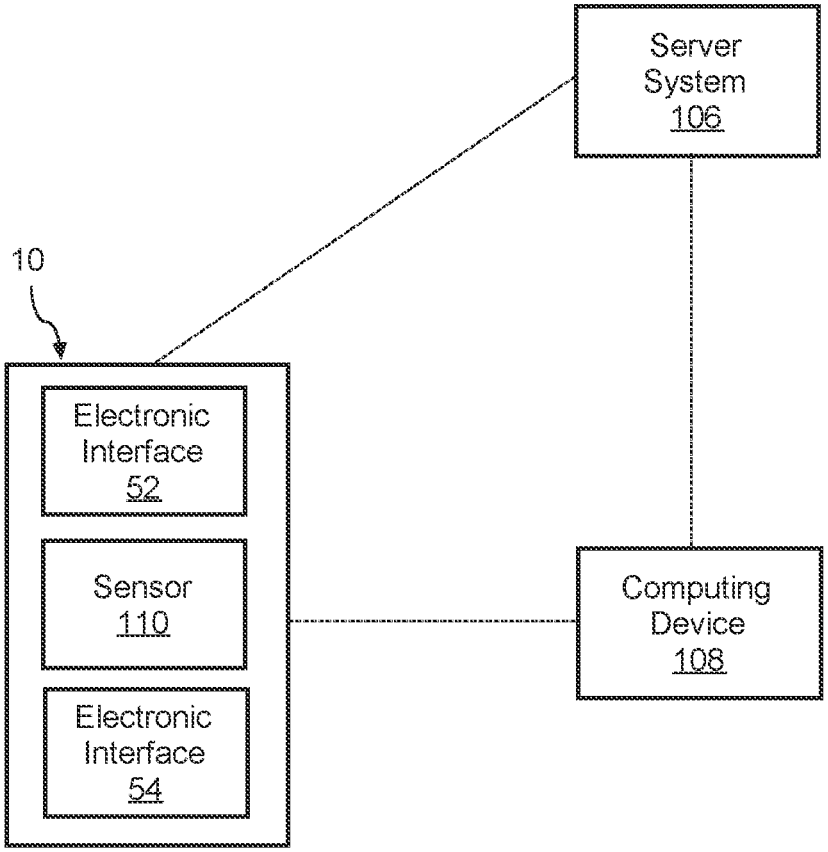
FIG. 9 illustrates a block diagram of an example network enable dispenser according to example embodiments of the present disclosure.

In certain embodiments, the dispenser 10 can utilize refill count system for accurately tracking refills of the dispensable product and also for alerting maintenance personnel when product remaining in the dispenser is below a threshold limit (e.g., a low product condition exists). Referring now to FIG. 9, the total quantity of a full product dispenser is known and can be stored on a server system 106 and/or computing device 108 in communication with the dispenser 10 and additionally or alternatively, one or more computing devices 108. Optionally, in certain embodiments, the dispenser 10 may be operably in communication (either wired or wireless) with the one or more computing devices 108. One or more sensors 110 can then be used to monitor the amount of available quantity of dispensable product in the product dispenser. For example, the sensor 110 can communicate the amount of product available in the dispenser to the server system 106 and/or the computing device 108. For example, the available quantity of dispensable product can be communicated to the server system 106 and/or computing device 108 via control circuitry or sensors located on or within the dispenser 10. The server system 106 or computing device 108 can then track the available quantity of dispensable product for a particular dispenser 10. Once a threshold amount of available quantity of dispensable product is reached (e.g., a low product condition is detected), the server system 106 and/or computing device 108 can generate an alert that the dispenser 10 has reached a low quantity and needs to be refilled. In embodiments, the server system 106 can generate the alert and send it to one or more computing devices 108. The computing device 108 can include any number of peripheral mobile devices, including smartphones and tablets. The specific threshold limit or low product condition can be stored on the server system 106 or the computing device 108. Once the maintenance personnel is alerted that a low product condition exists, they can open the dispenser 10 in order to refill the product dispenser 10. Upon opening of the dispenser 10 electronic interface 52 is disconnected from electronic interface 54, such disconnection can be used to indicate to the server system 106 and/or the computing device 108 that the dispenser has been refilled and is now fully stocked with product.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A dispenser for dispensing a dispensable product, comprising:

a housing having an interior volume so as to retain a dispensable product;

a front cover assembly forming at least a portion of the housing, the front cover assembly including a front plate having a first side and a second and opposite side, the first side forming an exterior of the dispenser, the second side facing the interior volume, a printed circuit board disposed on the second side of the front cover assembly;

a backplate forming at least a portion of the housing, the backplate including a first side and a second and opposite side, the first side forming an exterior of the dispenser, the second side facing the interior volume, one or more power packs disposed on the second side of the backplate; wherein the backplate includes a housing member, wherein the one or more power packs are disposed in the housing member;

wherein a first electronic interface is disposed on an external surface of the housing member and is configured to electronically couple the one or more power packs to a second electronic interface disposed on the second side of the front plate when the front cover assembly is in a closed position; and wherein the printed circuit board is powered by the one or more power packs when the front cover assembly is in a closed position, wherein one or more light emitting devices are disposed on the printed circuit board and when the front cover assembly is in an open position the first and second electronic interfaces are not connected.

2. The dispenser of claim 1, wherein disconnection of the first electronic interface and the second electronic interface indicates to a server system or a computing device that the dispenser is fully stocked with product.

3. The dispenser of claim 1, wherein the printed circuit board comprises an activation sensor capable of powering the one or more light emitting devices when a user is located within a certain distance from the dispenser.

4. The dispenser of claim 1, wherein the front plate includes a first layer comprising an opaque material and a second layer comprising a transparent material, wherein a border of the second layer is formed on at least a portion of the external surface of the dispenser, wherein the one or more light emitting devices are configured to light up at least a portion of the border.

5. The dispenser of claim 4, wherein the first layer includes a transparent logo thereon, wherein the one or more light emitting devices are configured to illuminate at least a portion of the logo.

6. The dispenser of claim 1, wherein a protection plate is disposed between the second side of the front plate and the interior volume of the dispenser.

7. The dispenser of claim 1, wherein the housing includes a holding member configured to hold a supply of folded sheets in the interior volume of the dispenser.

8. The dispenser of claim 1, comprising a second front cover assembly including a second printed circuit board, wherein the second printed circuit board is configured to provide a different functionality to the dispenser.

9. The dispenser of claim 1, wherein one or more smaller power packs are disposed on the printed circuit board, wherein the one or more smaller power packs are capable of powering the printed circuit board when the front cover assembly is in an open position.

10. The dispenser of claim 1, wherein the printed circuit board includes one or more refill detection sensors for indicating when a low product condition exists.

11. The dispenser of claim 1, wherein the printed circuit board includes one or more user detection sensors.

12. The dispenser of claim 1, wherein the printed circuit board includes one or more components configured to receive and transmit data via a wireless protocol.

13. The dispenser of claim 12, wherein the wireless protocol includes Long Range (LoRa), Near Field Communication (NFC), High-Frequency (HF) RFID, Ultra-High Frequency (UHF) RFID, Ultra-wideband (UWB), Institute of Electrical and Electronics Engineers (IEEE) 802.15.4, Thread, Zigbee, Wirepass, Encoean/ISO/IEC 14543.3.1x, WiFi or IEEE 802.11, cellular services (e.g., 4G Long-Term Evolution (LTE), 5G, etc.), NarrowBand-Internet of Things (NB-IoT), and combinations thereof.

14. The dispenser of claim 1, wherein the printed circuit board is configured to power an electromechanical lock configured to open the dispenser when an electronic key is interfaced with the electromechanical lock.

15. The dispenser of claim 1, wherein the dispensable product comprises one or more rolls of sheet material.

16. The dispenser of claim 1, wherein the dispensable product comprises a liquid dispensable product.

17. The dispenser of claim 1, comprising a dispensing mechanism disposed within the housing for dispensing the dispensable product.

* * * * *